US009803344B2

(12) United States Patent
Carpenter-Crawford

(10) Patent No.: US 9,803,344 B2
(45) Date of Patent: Oct. 31, 2017

(54) HANDHELD SPRAYER WITH SINGLE-HANDED SPRAYING AND AERATING MODES

(71) Applicant: BrassCraft Manufacturing Company, Novi, MI (US)

(72) Inventor: Evan A. Carpenter-Crawford, Farmington, MI (US)

(73) Assignee: Brasscraft Manufacturing Company, Novi, MI (US)

( * ) Notice: Subject to any disclaimer, the term of this patent is extended or adjusted under 35 U.S.C. 154(b) by 114 days.

(21) Appl. No.: 14/674,014

(22) Filed: Mar. 31, 2015

(65) Prior Publication Data

US 2016/0040404 A1 Feb. 11, 2016

Related U.S. Application Data

(60) Provisional application No. 62/034,335, filed on Aug. 7, 2014.

(51) Int. Cl.

| | |
|---|---|
| ***E03C 1/244*** | (2006.01) |
| ***E03C 1/04*** | (2006.01) |
| ***E03C 1/18*** | (2006.01) |
| ***E03C 1/26*** | (2006.01) |
| ***E03C 1/264*** | (2006.01) |
| ***B05B 1/06*** | (2006.01) |
| ***B05B 1/12*** | (2006.01) |
| ***B05B 1/16*** | (2006.01) |
| ***B05B 1/30*** | (2006.01) |
| ***B05B 12/00*** | (2006.01) |

(52) U.S. Cl.

CPC ..... *E03C 1/0405* (2013.01); *B05B 1/06* (2013.01); *B05B 1/12* (2013.01); *B05B 1/1618* (2013.01); *B05B 1/1663* (2013.01); *B05B 1/3046* (2013.01); *B05B 12/002* (2013.01); *E03C 1/18* (2013.01); *E03C 1/244* (2013.01); *E03C 1/26* (2013.01); *E03C 1/264* (2013.01)

(58) Field of Classification Search

CPC ..... E03C 1/186
USPC ..... 4/619–660
See application file for complete search history.

(56) References Cited

U.S. PATENT DOCUMENTS 1,503,296 A * 7/1924 Bradley ..... B25B 13/505 81/98
2,641,092 A * 6/1953 Garrison ..... B24B 3/26 451/24
2,672,621 A * 3/1954 Drain ..... E03C 1/33 4/636
3,520,481 A * 7/1970 Moen ..... E03C 1/084 239/428.5

(Continued)

*Primary Examiner* — Lori Baker
(74) *Attorney, Agent, or Firm* — Reising Ethington, P.C.

(57) ABSTRACT

A handheld sink sprayer with single-handed metering and discharge mode adjustment. A body includes a handle portion, and a nozzle portion extending from the handle portion. A metering valve is carried in the body, a finger-engageable actuator is carried by the body and is coupled to the metering valve to move the metering valve, and a nozzle is carried by the body nozzle portion. A discharge mode valve is carried by the body nozzle portion. A thumb-engageable actuator is carried by the body nozzle portion and is coupled to the discharge mode valve to move the discharge mode valve between different discharge modes of operation.

21 Claims, 5 Drawing Sheets

(56) References Cited

U.S. PATENT DOCUMENTS 3,647,144 A * 3/1972 Parkison ..... B05B 1/1681 239/456
3,786,995 A * 1/1974 Manoogian ..... E03C 1/084 239/428.5
4,310,107 A * 1/1982 Wesner ..... B05B 11/303 137/512
5,221,050 A * 6/1993 Jeffries ..... B05B 5/035 222/103
5,348,231 A * 9/1994 Arnold ..... E03C 1/084 239/428.5
5,450,647 A * 9/1995 Dorsey ..... A47K 7/046 15/21.1
5,752,626 A * 5/1998 Bachand ..... B05B 1/3436 222/136
D463,005 S * 9/2002 Lord ..... B05B 1/3436 D23/226
D463,006 S * 9/2002 Lord ..... B05B 1/3436 D23/226
D463,526 S * 9/2002 Lord ..... E03C 1/084 D23/226
D468,395 S * 1/2003 Lord ..... E03C 1/084 D23/223
D471,955 S * 3/2003 Lord ..... B05B 7/2443 D23/223
D484,217 S * 12/2003 Lord ..... B05B 7/2443 D23/226
7,343,930 B2 * 3/2008 Rosko ..... E03C 1/04 137/597
D582,019 S * 12/2008 Yuan ..... E03C 1/04 D23/255
7,472,846 B2 * 1/2009 Thomas ..... E03C 1/084 239/391
7,731,846 B1 * 6/2010 Jones ..... B65F 1/06 210/248
D621,479 S * 8/2010 McNerney ..... B65F 1/06 D23/249
7,798,429 B1 * 9/2010 Porter ..... B05B 7/2427 239/353
D649,053 S * 11/2011 Van den Broeck ..... E03C 1/18 D9/448
8,156,580 B1 * 4/2012 Paone ..... E03C 1/18 4/619
D701,288 S * 3/2014 Andrew ..... B05B 11/0018 D23/213
D709,991 S * 7/2014 Loudon ..... B05B 11/0018 D23/223
D713,014 S * 9/2014 Schoenherr ..... B05B 11/0018 D23/252
D717,296 S * 11/2014 Oh ..... B05B 11/0018 D14/316
2005/0103893 A1 * 5/2005 Birrenkott ..... B05B 7/2443 239/345
2006/0231140 A1 * 10/2006 McNerney ..... E03C 1/021 137/360
2006/0237559 A1 * 10/2006 Chih ..... B05B 1/1654 239/394
2014/0061233 A1 * 3/2014 Lang ..... B05B 11/0018 222/1

* cited by examiner

HANDHELD SPRAYER WITH SINGLE-HANDED SPRAYING AND AERATING MODES

CROSS-REFERENCE TO RELATED APPLICATION

This application claims the benefit of U.S. Provisional Application No. 62/034,335, filed Aug. 7, 2014. The content of the above application is incorporated herein by reference in its entirety.

TECHNICAL FIELD

This disclosure relates generally to sprayers and, more particularly, to handheld sprayers for sinks.

BACKGROUND

Many sinks include a basin, a mounting flange around the basin, a drain in the basin, and a faucet carried on the mounting flange. Some sinks also include a pull-down sprayer extending from a faucet and/or a handheld sprayer carried by the mounting flange next to the faucet. Pull-down sprayers may have actuators for different discharge modes of operation, for example, spraying and aerating. Handheld sprayers may have actuators for different metering states, for example, on and off and any flow levels therebetween. But handheld sprayers for sinks typically do not include actuators for different discharge modes in addition to different metering states. And sink sprayers of both types typically require two-handed operation; with one hand on an actuator of the sprayer and with another hand on a separate, remotely located faucet valve.

BRIEF SUMMARY

An illustrative embodiment of a handheld sink sprayer with single-handed metering and discharge mode adjustment includes a body including a handle portion and a nozzle portion extending from the handle portion. The sprayer also includes a metering valve carried in the body, a finger-engageable actuator carried by the body and coupled to the metering valve to move the metering valve, and a nozzle carried by the body nozzle portion. The sprayer further includes a discharge mode valve, and a thumb-engageable actuator carried by the body nozzle portion and coupled to the discharge mode valve to move the discharge mode valve between different discharge modes of operation

Appendices A and B constitute disclosure and claims for a design that is hereby incorporated by reference herein in its entirety.

DETAILED DESCRIPTION

Figure 1:
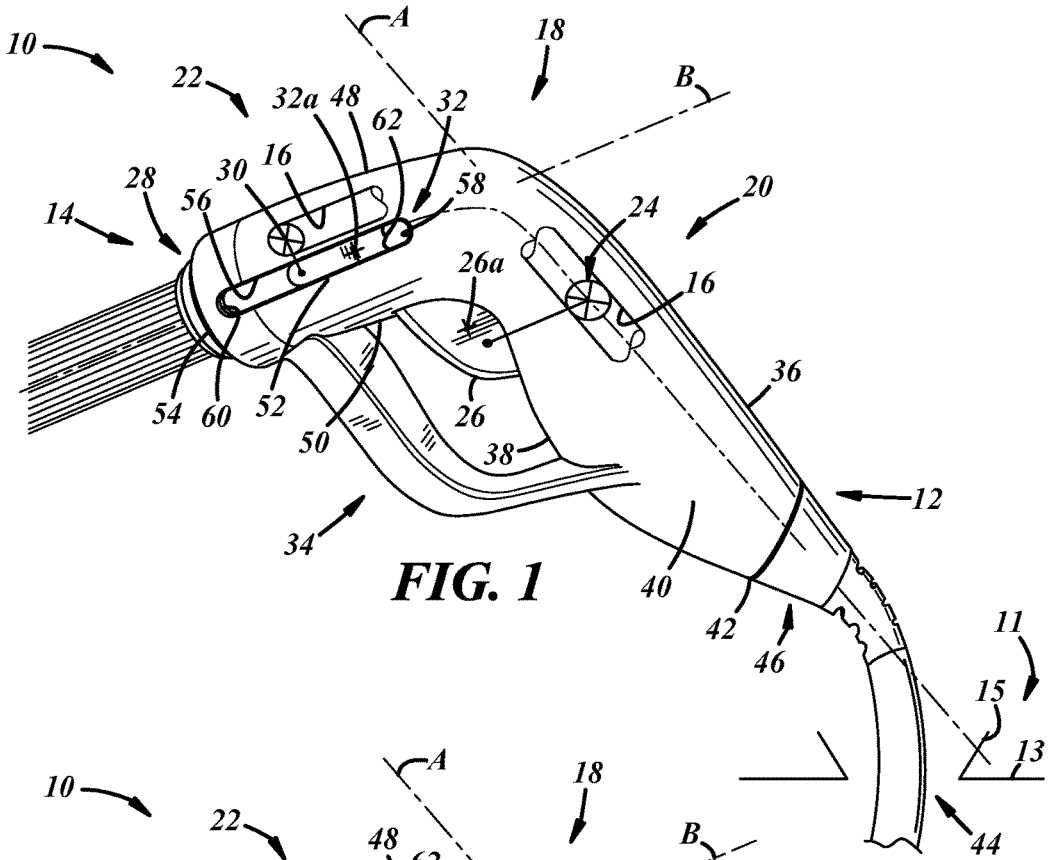
FIG. 1 is a perspective view of a handheld sprayer exhibiting an aerating mode, in accordance with an embodiment of the present disclosure.

Referring specifically to the drawings, FIG. 1 shows an illustrative embodiment of a sink sprayer 10 having single-handed metering and discharge mode adjustment. The sprayer 10 may be a handheld, gun-style, flange-mount sprayer, as distinct from a faucet-mount, pull-down sprayer. The sprayer 10 includes an inlet 12 to receive fluid, for example, water, an outlet 14 to discharge water from the sprayer 10, and a conduit 16 therebetween. The sprayer 10 also includes a body 18 including a handle portion 20 and a nozzle portion 22 extending from the handle portion 20. The sprayer 10 also includes a first valve 24 carried in the body 18 and in fluid communication with the conduit 16 to control flow of water through the sprayer 10 from the inlet 12 to the outlet 14, and a finger-engageable actuator 26 carried by the body 18 and coupled to the first valve 24 to move the first valve 24. The sprayer 10 further includes a nozzle 28 carried by the body nozzle portion 22 at the outlet 14, and a mode valve 30 located at a forward end of the nozzle portion 22 and movable between different discharge modes of operation. The sprayer additionally includes a thumb-engageable actuator 32 carried by the nozzle portion 22 and coupled to the discharge mode valve 30 to move the discharge mode valve 30 between the different discharge modes.

A user may grasp the sprayer 10, actuate the finger-engageable actuator 26 with a finger of one hand and, simultaneously, actuate the thumb-engageable actuator 32 with the thumb of the same hand without having to release the finger actuator 26. Accordingly, unlike conventional sink sprayers, the presently disclosed sink sprayer 10 is capable of being operated with a single hand of a user to carry out different metering and discharge modes.

The body 18 may include an external housing as shown in the figures (not separately numbered), but also may include an internal structure carried inside the housing, which may include the conduit 16 among any other suitable framework, fittings, or any other suitable structure. The housing may include two or more shells (not separately shown or numbered) that may be snap fit, fastened, or otherwise coupled together around the internal structure.

The body 18 also may include, in addition to the handle and nozzle portions 20, 22, an actuator guard 34 extending between the handle and nozzle portions 20, 22. The actuator guard 34 may guard the finger-engageable actuator 26 from being inadvertently actuated, for example, if the sprayer 10 is dropped, knocked against something, or the like. The actuator guard 34 may be an integral portion of one or both of the handle or nozzle portions 20, 22 of the body 18 and, more specifically, may include a portion of an external housing of the body 18.

The body handle portion 20 may extend along a handle axis A, and may include a rear portion 36, a front portion 38, side portions 40 between the rear and front portions 36, 38, and an upstream portion 42. The upstream portion 42 may be coupled to a conduit 44, which may have a coupling 46 coupled to the upstream portion 42 of the sprayer 10 such that the sprayer 10 and the conduit 44 constitute at least part of a fluid distribution assembly. For example, the upstream portion 42 may include external threads (not shown) for cooperating with internal threads (not shown) of the conduit coupling 46, or quick-disconnect features (not shown) for cooperating with corresponding quick-disconnect features (not shown) of the conduit coupling 46, or any other suitable coupling features. The inlet 12 of the sprayer 10 may be part of the upstream portion 42 of the body 18. Also, the sprayer 10 may be part of a sink 11, which may include a mounting flange 13, and a sprayer coupling 15 that may be used to couple the sprayer 10 to the mounting flange 13 of the sink 11.

The body nozzle portion 22 may extend along a nozzle axis B disposed at a non-zero angle with respect to the handle axis A, and may include a top 48, a bottom 50, sides 52 between the top 48 and the bottom 50, and a downstream portion 54. The thumb-engageable actuator 32 may be carried through at least one of the sides 52. The nozzle portion 22 may include an actuator opening 56 through a wall of the body 18. The opening may include a slot having a first end 58, a second end 60, and guide surfaces 62 extending therebetween. The nozzle axis B may be disposed at an angle of about ninety degrees, plus or minus twenty degrees, or at any other suitable non-zero angle, with respect to the handle axis A. Preferably, the actuator 32 is carried by and movable along the side(s) 52 and perhaps a portion of the bottom 50, but not the top 48, for good accessibility and smooth operation.

The first valve 24 may include a poppet valve, ball valve, plug valve, spool valve, or any other type of valve suitable for use in metering or on/off control of flow of water through a handheld sprayer. The first valve 24 normally may be in a closed-flow position and may be movable from the closed-flow position to an open-flow position, and vice-versa, and anywhere in between to adjust fluid flow. The first valve 24 may be biased to the closed-flow position by a spring (not shown).

The finger-engageable actuator 26 may include a trigger as illustrated, but instead may include a button, a slider, lever, or any other suitable mechanical actuator, or even a capacitive touch actuator, or any other suitable electrical actuator. In any case, the actuator 26 may be carried between the handle and nozzle portions 20, 22 of the body 18, such that application of pressure by a finger of a hand of a user against the actuator 26 may cause the actuator 26 to move toward the body 18.

Figure 3:
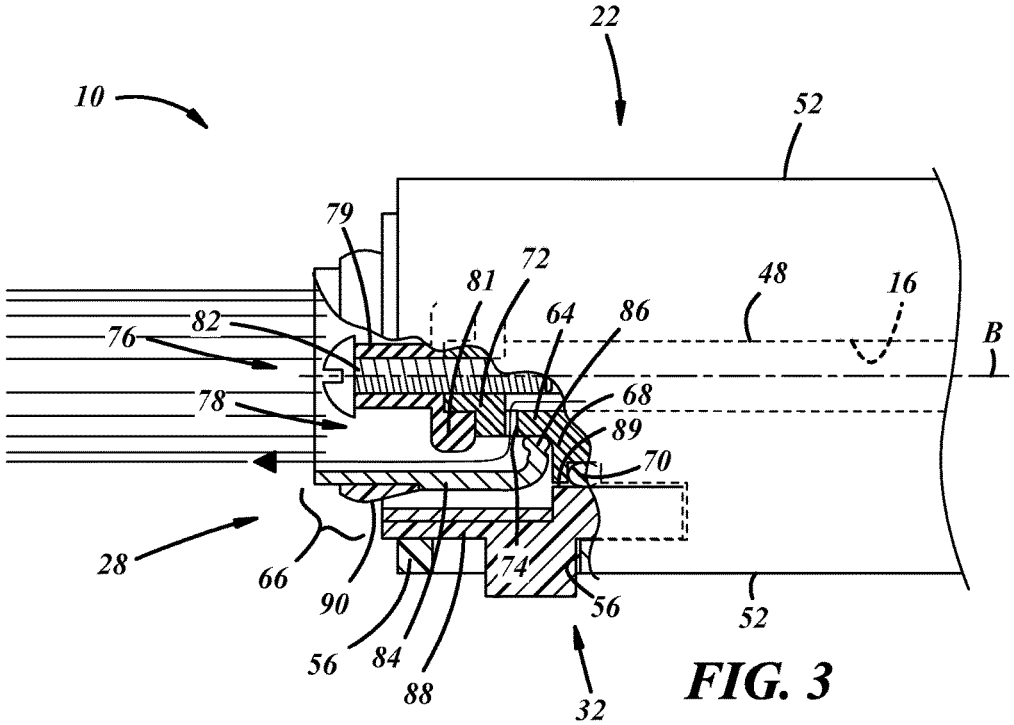
FIG. 3 is an enlarged, fragmentary, top, sectional view of the sprayer of FIG. 1.
Figure 4:
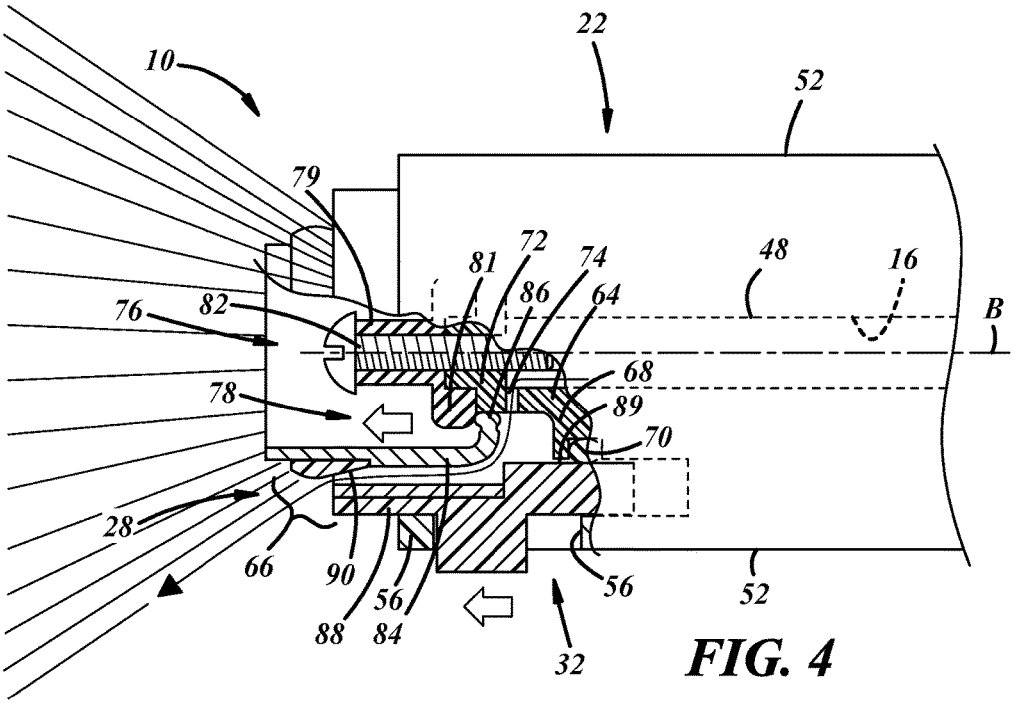
FIG. 4 is an enlarged, fragmentary, top, sectional view of the sprayer of FIG. 2.

With reference to FIGS. 3 and 4, the nozzle 28 may include a fixed portion 64 fixed with respect to the body 18 and a movable portion 66 movable with respect to the fixed portion 64 and the body 18.

The nozzle fixed portion 64 may include the conduit 16 of the body 18 or any other suitable portion of the body 18. The fixed portion 64 may include a shoulder 68 carrying a seal 70, an end 72, and one or more valve ports 74 between the shoulder 68 and the end 72 and extending transversely through the conduit 16, for example, perpendicularly, or even radially, with respect to the axis B. The fixed portion 64 also may include an aerator assembly 76 including one or more aerator screens 78, a screen support 80 having a stem 79 extending through the screens 78 and a shoulder 81 located against the end 72 of the fixed portion 64, and a fastener 82 extending through the screens 78 and the support 80 and fastened to the end 72 of the fixed portion 64.

Figure 2:
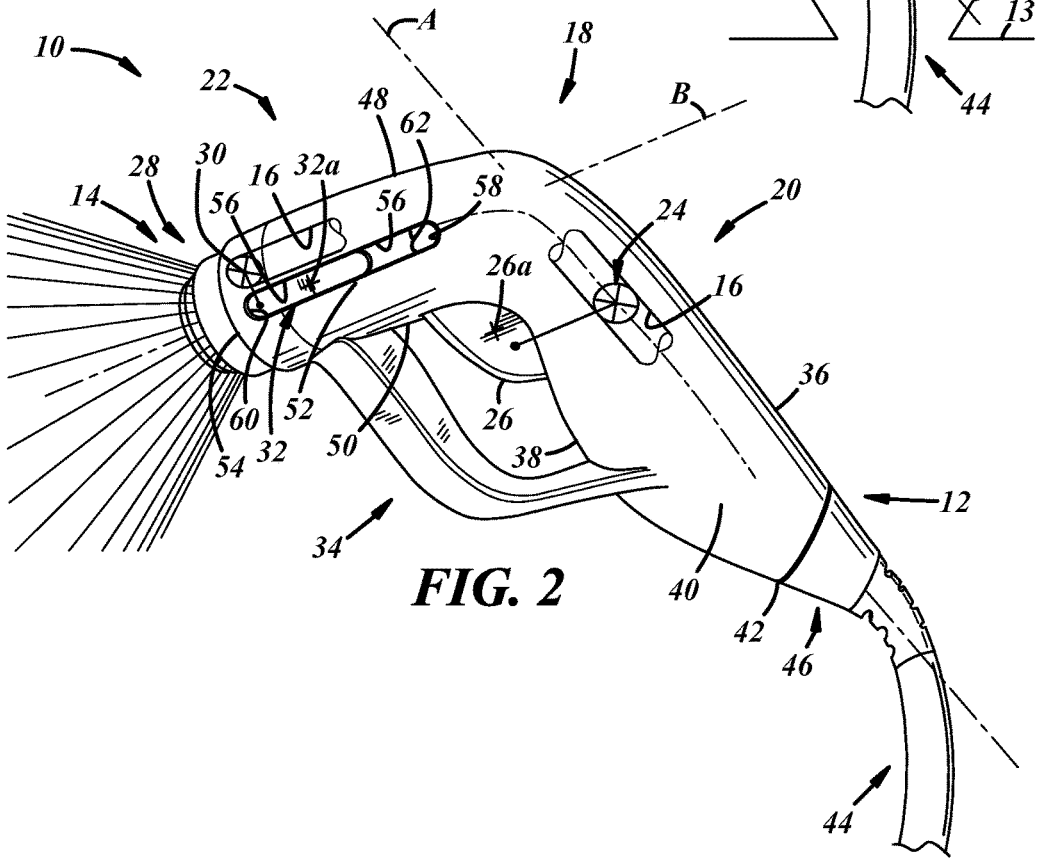
FIG. 2 is a perspective view of the sprayer of FIG. 1 exhibiting a spraying mode.

The nozzle movable portion 66 may include an inner shroud 84 having a downstream portion circumscribing at least part of the aerator assembly 76, and an upstream portion circumscribing at least a portion of the conduit 16. The upstream portion may include an annular valve head 86 that may circumferentially contact the fixed portion 64 adjacent to the valve port(s) 74 and may be movable across the port(s) 74. Accordingly, the valve head 86 and the port(s) 74 may constitute at least part of the discharge mode valve 30 (FIGS. 1 and 2). The movable portion 66 also may include an outer shroud 88 circumscribing at least a portion of the inner shroud 84, and having an inner surface 89 in contact with the seal 70. The movable portion 66 further may include a spray director 90 to define a spray pattern, and that may be carried between and coupled to the shrouds 84, 88 by interference fit, threading, or any other suitable coupling arrangement.

The thumb-engageable actuator 32 may be an integral portion of the outer shroud 88, as shown in the illustrated embodiment. In other embodiments, the actuator 32 may be a separate component fastened, welded, adhered, or otherwise coupled to the outer shroud 88. The actuator 32 may extend through the actuator opening 56 through the wall of the body 18. The actuator 32 may include a slider, lever, or any other suitable movable element that may extend through the body 18 and is slidable, pivotable, or otherwise movable, for example, between the first and second ends of the slot 56 in response to application of pressure by a thumb of a hand of a user. The actuator 32 may be slidable substantially parallel (within +/−5 angular degrees) to the nozzle axis B.

With reference to FIGS. 1 and 2, although the elements may overlap in a direction along the nozzle axis B, generally the thumb-engageable actuator 32 may be positioned on the nozzle portion 22 of the sprayer body 18 in a location forward of the finger-engageable actuator 26 in a direction along the nozzle axis B. For example, as shown in FIG. 1, even when the thumb-engageable actuator 32 is in a rear-most position, a forwardmost portion of the actuator 32 is axially forward of the finger-engageable actuator 26. In another example, as shown in FIGS. 1 and 2, a central portion or centroid 32*a* of the thumb-engageable actuator 32 is axially forward of a central portion or centroid 26*a* of the finger-engageable actuator 26.

In operation, and with reference to FIGS. 1 and 2, a user may grasp the handle portion 20 of the sprayer 10 with one hand by trapping the handle portion 20 between a palm of the hand and one or more of the middle, ring, or little fingers of the same hand. Then the user may place the index finger from the same hand over the actuator 26, and press or pull the actuator 26 to move the first valve 24 to the open-flow position. Next, the user may place a thumb from the same hand on the actuator 32, and move the thumb back and forth to move the actuator 32 back and forth between the different discharge modes.

With reference to FIGS. 3 and 4, when the actuator 32 is moved from the aerating mode of FIG. 3, the valve head 86 slides across the valve port(s) 74 from an upstream side of the port(s) 74 to a downstream side of the port(s) 74. Accordingly, water flows through the port(s) 74, around the outside of the inner shroud 84 within the outer shroud 88, through the spray director 90, and out of the sprayer 10 in an annular or conical pattern. Conversely, when the actuator 32 is moved from the spraying mode of FIG. 4, the valve head 86 slides back across the valve port(s) 74 from the downstream to the upstream sides of the port(s) 74. Accordingly, water flows through the port(s) 74, within the inside of the inner shroud 84, through the aerator screens 78, and out of the sprayer 10 in a cylindrical or columnar pattern.

FIGS. 5-9 illustrate another illustrative embodiment of a sprayer 110 with single-handed metering and discharge mode adjustment. This embodiment is similar in many respects to the embodiment of FIGS. 1-4. Accordingly, the descriptions of the embodiments are hereby incorporated into one another, and description of subject matter common to the embodiments generally may not be repeated.

Figure 6:
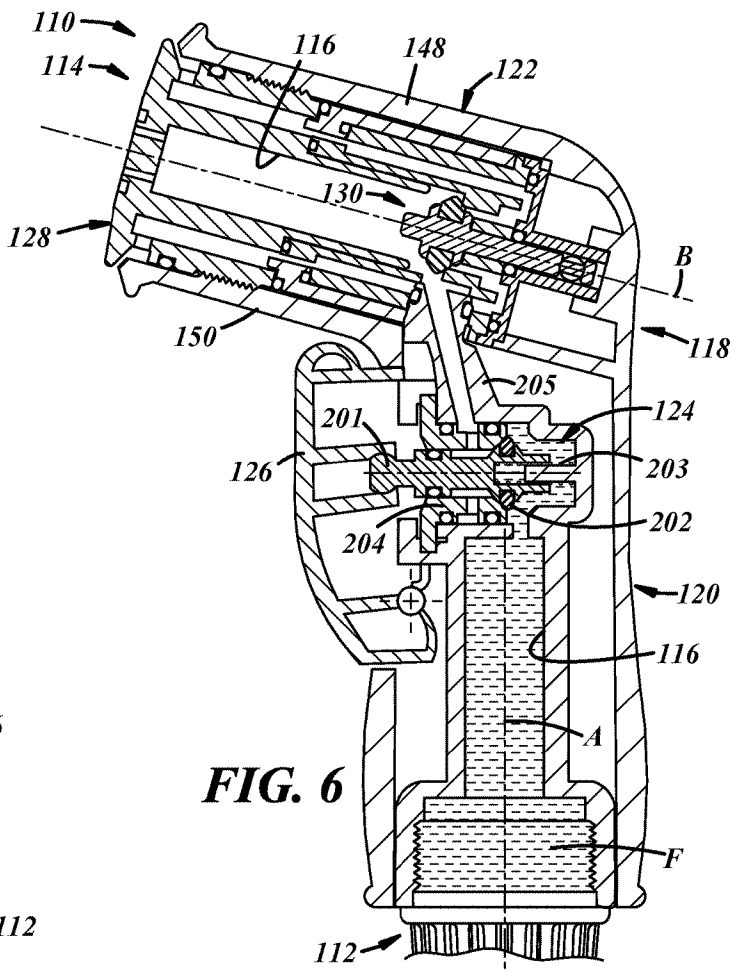
FIG. 6 is an enlarged, fragmentary, side cross-sectional view of the sprayer of FIG. 5, illustrating an off mode.
Figure 5:
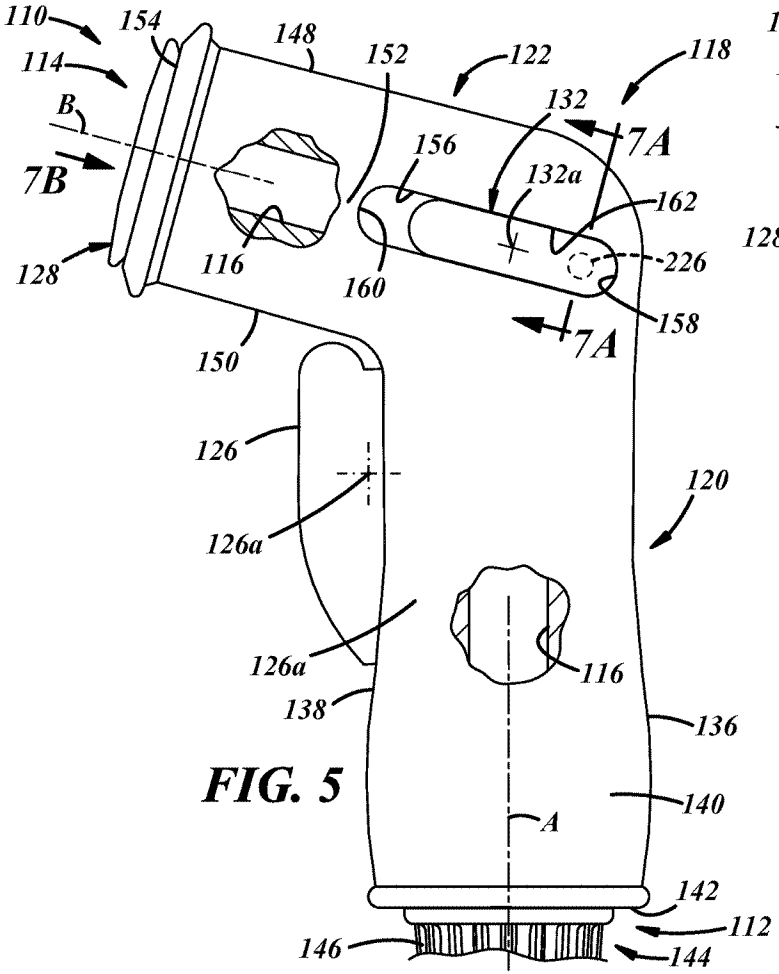
FIG. 5 is a fragmentary side view of a handheld sprayer in accordance with another embodiment of the present disclosure.

With reference to FIGS. 5 and 6, the handheld sprayer 110 includes an inlet 112 to receive fluid F, an outlet 114 to discharge fluid F from the sprayer 110, and conduit 116 therebetween. The sprayer 110 also includes a body 118 including a handle portion 120, and a nozzle portion 122 extending from the handle portion 120. The sprayer 110 also includes a first valve 124 (FIG. 6) carried in the body 118 and in fluid communication with the conduit 116 to control flow of fluid F through the sprayer 110 from the inlet 112 to the outlet 114, and a finger-engageable actuator 126 carried by the body 118 and coupled to the first valve 124 to move the first valve 124 (FIG. 6). The sprayer 110 further includes a nozzle 128 carried by the body nozzle portion 122 at the outlet 114, a discharge mode valve 130 (FIG. 6) located at a rearward end of the nozzle portion 122 and movable between different discharge modes, and a thumb-engageable actuator 132 carried by the nozzle portion 122 and coupled to the discharge mode valve 130 (FIG. 6) to move the discharge mode valve 130 between the different discharge modes.

The body 118 may include an external housing as shown in the figures (not separately numbered), but also may include an internal structure carried inside the housing, which may include the conduit 116 among any other suitable framework, fittings, or any other suitable structure. The housing may include two or more shells (not separately shown or numbered) that may be snap fit, fastened, or otherwise coupled together around the internal structure.

The body handle portion 120 may extend along a handle axis A, and may include a rear portion 136, a front portion 138, side portions 140 between the rear and front portions 136, 138, and an upstream portion 142. The upstream portion 142 may be coupled to a conduit 144, which may have a coupling 146 coupled to the upstream portion 142 of the sprayer 110 such that the sprayer 110 and the conduit 144 constitute at least part of a fluid distribution assembly. The inlet 112 of the sprayer 110 may be part of the upstream portion 142 of the body 118.

The body nozzle portion 122 may extend along a nozzle axis B disposed at a non-zero angle with respect to the handle axis A, and may include a top 148, a bottom 150, sides 152 between the top 148 and the bottom 150, and a downstream portion 154. The thumb-engageable actuator 132 may be carried through at least one of the sides 152. The nozzle portion 122 may include an actuator opening 156 through a wall of the body 118. The opening may include a slot having a first end 158, a second end 160, and guide surfaces 162 extending therebetween. The nozzle axis B may be disposed at an angle of about 110 degrees, plus or minus twenty degrees, or at any other suitable non-zero angle, with respect to the handle axis A. Preferably, the actuator 132 is carried by and movable along the side(s) 152 and perhaps a portion of the bottom 50, but not the top 48, for good accessibility and smooth operation.

With reference to FIG. 6, the first valve 124 may include a spool 201 that may carry one or more seals 202, or may include any other type of valve suitable for use in metering or on/off control of flow of fluid F through a handheld sprayer. The spool 201 of the first valve 124 normally may be in a closed-flow position, for instance as illustrated in FIG. 6, and may be movable from the closed-flow position to an open-flow position, and vice-versa. The spool 201 may be coupled to the actuator 126 at one end and may be biased at an opposite end to the closed-flow position by a spring 203, which may include a compression coil spring for example as illustrated, or an elastomeric spring, or any other type of spring for use in biasing the actuator 126 away from the body 118. The spool 201 may be carried in a valve body 204. In turn, the valve body 204 may be carried in a pocket of a tubular fitting 205, which may be carried in the handle portion 120 of the sprayer body 118. Of course, the valve 124 and related structure may include various seals for suitably sealing the assembly, for example, as illustrated, or in any other suitable manner.

The finger-engageable actuator 126 may include a trigger as illustrated, but instead may include a button, a slider, lever, or any other suitable mechanical actuator, or even a capacitive touch actuator, or any other suitable electrical actuator. In any case, the actuator 126 may be carried by the handle portions 120 of the body 118.

A user may grasp the sprayer 110, actuate the finger-engageable actuator 126 by application of pressure by one or more fingers of one hand and, simultaneously, actuate the thumb-engageable actuator 132 by application of pressure by the thumb of the same hand without having to release the finger actuator 126. For example, the thumb-engageable actuator 132 may be positioned on the nozzle portion 122 of the sprayer body 118 in a location rearward of the finger-engageable actuator 126 in a direction along the nozzle axis B. More specifically, a central portion or centroid 132*a* of the thumb-engageable actuator 132 may be located axially rearward of a central portion or centroid 126*a* of the finger-engageable actuator 126.

In operation, a user may grasp the handle portion 120 of the sprayer 110 with one hand by trapping the handle portion 120 between a palm of the hand and one or more of the middle, ring, or little fingers of the same hand. Then the user may pull one or more of those fingers against the actuator 126 to cause the actuator 126 to move toward the body 118 to displace the valve 202 to allow fluid F to flow downstream toward the discharge mode valve 130.

Figure 7A:
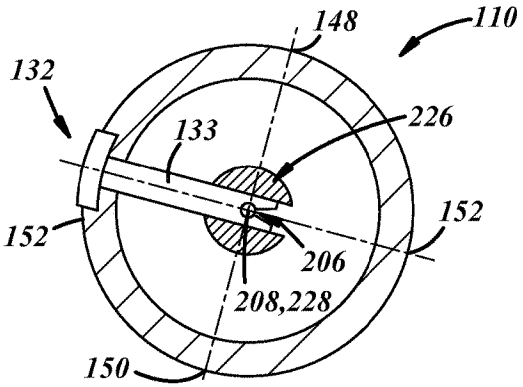
FIG. 7A is a fragmentary, rear sectional view of the sprayer of FIG. 5, illustrating an actuator/valve coupling arrangement.
Figure 7B:
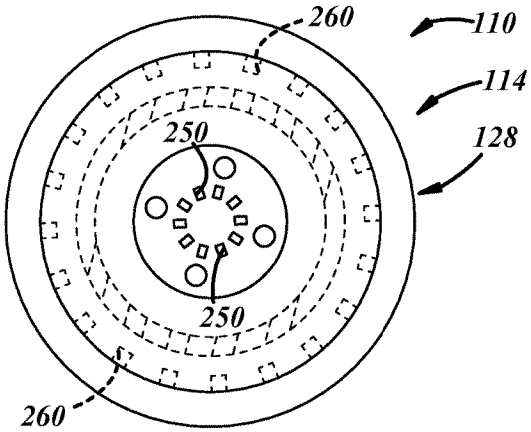
FIG. 7B is a front view of an outlet of the sprayer of FIG. 5.
Figure 7:
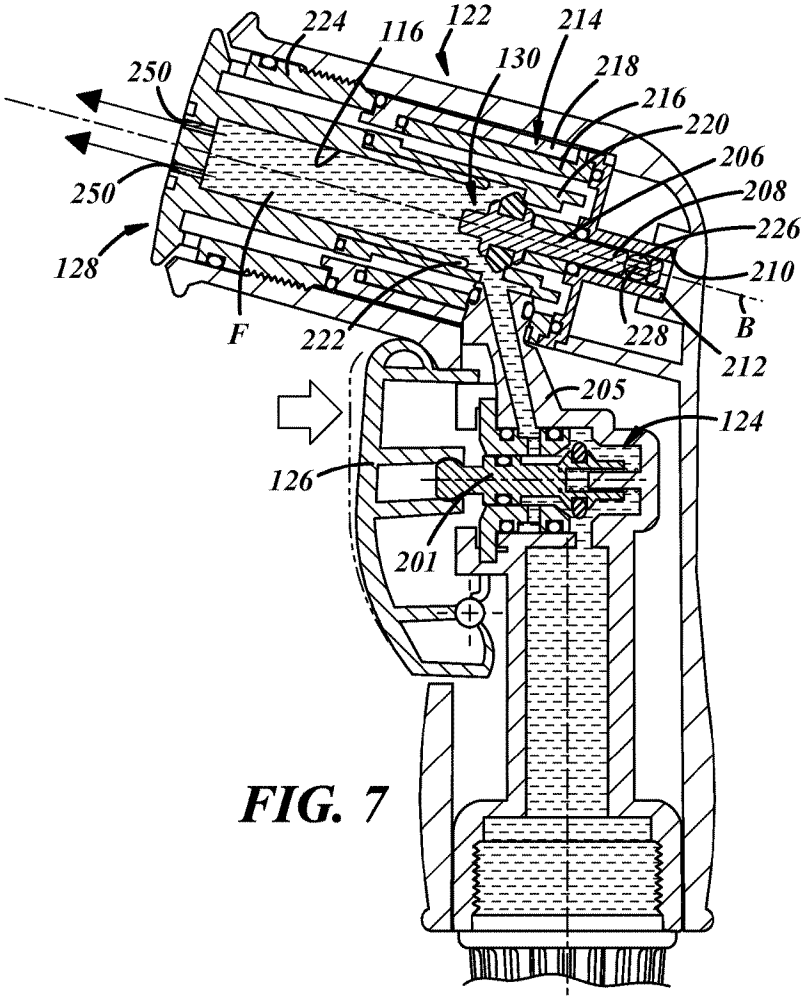
FIG. 7 is a view of the sprayer of FIG. 5, similar to FIG. 6 but illustrating an on/aerating mode.

Accordingly, and with reference to FIG. 7, the actuator 126 is illustrated in a position moved toward the body 118 and the spool 201 is illustrated in a displaced position to allow fluid F to flow through the metering valve 124 downstream toward the discharge mode valve 130 through a downstream portion of the tubular fitting 205. The discharge mode valve 130 may include a movable element 206, which may include a poppet and a seal in an annular groove of an enlarged head of the poppet at one end. The valve element 206 may include a stem 208, which may be carried by the body 118. For example, the body 118 may include an internal pocket 210, which may carry a bushing 212, which, in turn, may carry the stem 208 for slidable movement of the poppet 206. Of course, the valve 130 and related structure may include various seals for suitably sealing the assembly, for example, as illustrated, or in any other suitable manner.

The valve 130 also may include a valve body 214 that cooperates with the poppet 206 to redirect fluid F flow. The valve body 214 may include a radially outer wall 216 that may be carried in the sprayer body nozzle portion 122 directly in contact therewith or via a bushing 218 therebetween. The valve body 214 also may include a radially inner wall 220 that may establish a first valve seat to cooperate with the valve element 206.

The valve 130 also may include another radially inner wall 222 that may establish a second valve seat axially opposite the first valve seat to cooperate with the valve element 206. The wall 222 may include an extension of the nozzle 128, which also may include a radially outer wall 224, which may be carried in the nozzle portion 122 proximate the outlet 114 and may be coupled thereto via cooperating external and internal threads, or via snap-fit, a retainer ring, or in any other suitable manner.

With reference to FIG. 7A, the valve element 206 may be coupled to the actuator 132 via a coupling 226. The coupling 226 may include for example, a stem 133 of the actuator 132 that may extend radially inwardly and may be interconnected to a reduced diameter portion 228 of the stem 208 of the valve element 206. The stems 133, 208 may be coupled via an integral snap-fit connection, a simple forked connection, or in any other suitable manner.

In the first discharge mode, and with reference to FIG. 7, the fluid F flows through the conduit 116 established by the tubular fitting 205, through a port in the outer wall 216 of the valve body 214 into which the fitting 205 extends, through a port in the inner wall 220 of the valve body 214, past the valve 130, radially within the inner walls 220, 222 of the valve body 214 and the nozzle 128, and out of a first set of passages 250 of the nozzle 128, for example, aerator passages of an aerator portion of the nozzle 128, and in a cylindrical or columnar pattern. With reference to FIG. 7B, the aerator passages 250 may extend axially through a transverse wall of the nozzle 128 in a circumferential array, or in any other suitable configuration, in the first discharge mode or aerator mode. Conversely, in a second discharge mode or spray mode, fluid may flow out of a second set of passages 260, for example, spray passages of a spray portion of the nozzle 128. The passages 260 may include holes through the outer wall 224 of the nozzle 128 proximate the axial end thereof and corresponding reliefs in an axial end of the nozzle portion 122 of the body 118.

Figure 8:
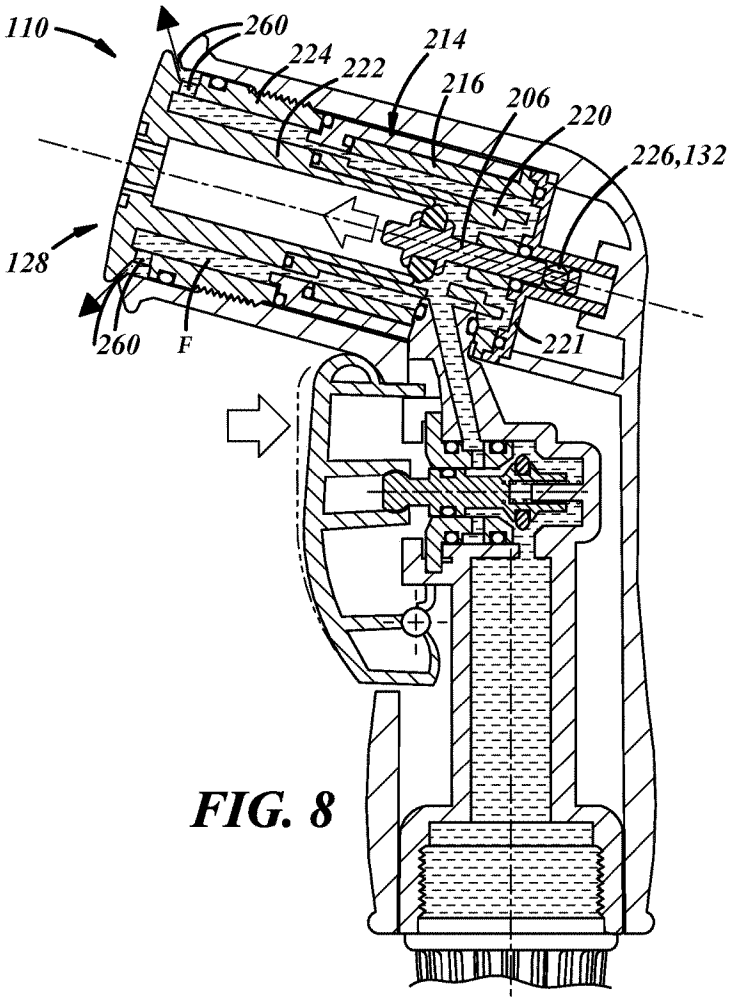
FIG. 8 is a view of the sprayer of FIG. 5, similar to FIG. 6 but illustrating an on/spraying mode.

In accordance with that mode, and with reference to FIG. 8, the user may place a thumb from the same hand on the actuator 132 (FIG. 5), and move the thumb forward to translate the actuator 132 so as to displace the valve element 206 toward a second position so as to redirect the fluid F through a second or spray path and out of the second set of passages 260 of the nozzle 128. More specifically, the fluid F flows from a location radially inwardly of the valve body inner wall 220, rearwardly to a radial flow plate 221 axially rearward of the valve body 214, radially outwardly to an annular channel radially between the valve body outer and inner walls 216, 220, and axially downstream through an annular channel between the inner and outer walls 222, 224 of the nozzle 128, and out the nozzle passages 260, for example, in an annular or conical pattern.

Figure 9:
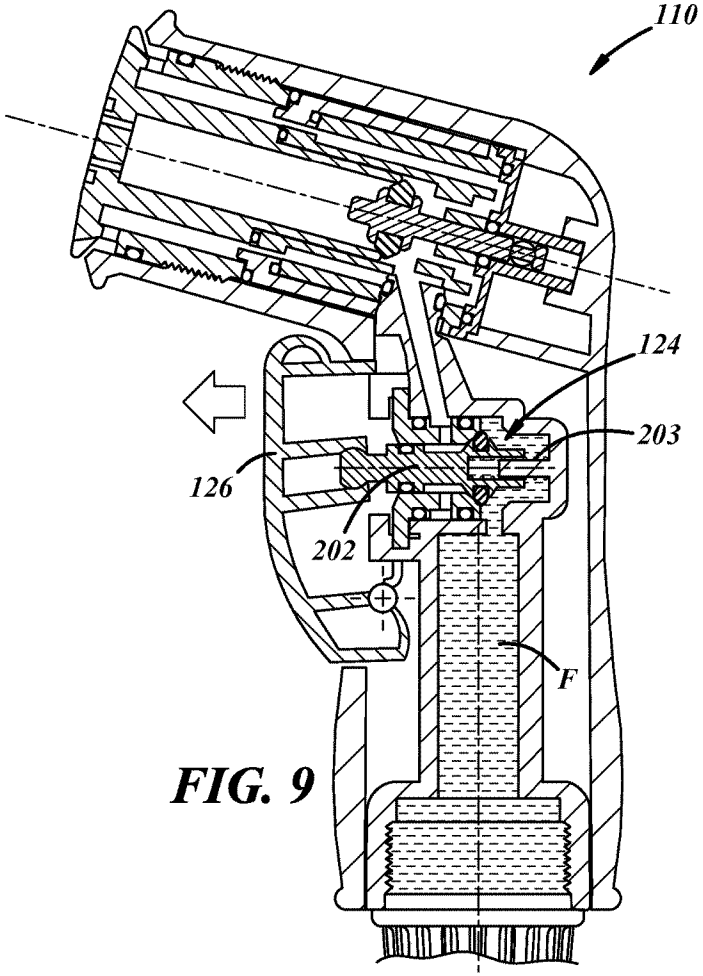
FIG. 9 is a view of the sprayer of FIG. 5, similar to FIG. 6 but illustrating another off mode.

With reference to FIG. 9, the actuator 126 can be released so that the spring 204 biases the valve element 202 to its home position to block flow of fluid past the valve 124, thereby ceasing operation of the sprayer 110. Accordingly, unlike conventional handheld sink sprayers, the presently disclosed handheld sink sprayer 110 is capable of carrying out different metering and discharge modes with a single hand of a user.

In general, the sprayers 10, 110 may be manufactured according to techniques known to those skilled in the art, including molding, machining, stamping, casting, and/or the like. For example, various portions of the bodies 12, 112 may be molded as a single piece. For instance, one half side of the bodies 12, 112 may be molded to include portions of the handle portions 20, 120, the nozzle portions 22, 122, and/or the actuator guard 34. Likewise, any suitable materials can be used in making the sprayers 10, 110, such as metals, composites, polymeric materials, and/or the like.

Some aspects of the configuration of the sink sprayers 10, 110 are significant in that they enable a solution to a problem apparently not addressed in the prior art of handheld sink sprayers. The presently disclosed sprayers 10, 110 provides multiple modes of operation in addition to metering states, including mode and metering valves that can be moved easily between different positions via single-handed operation. Moreover, the sprayers 10, 110 include thumb-engageable, axially slidable actuators located on sides of nozzle portions that are particularly easy to manipulate during single-handed operation. Accordingly, the presently disclosed sprayers 10, 110 provide a simple but effective solution to an everyday, common household problem. It is believed that the presently disclosed sprayers 10, 110 presents a new type of handheld sprayer: one capable of being metered or turned on and off with one or more fingers of one hand, and adjusted from one discharge mode to another with a thumb of the same hand without otherwise having to adjust a user's grip on the sprayer.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. A handheld sink sprayer with single-handed metering and discharge mode adjustment, and comprising:

a body including a handle portion and a nozzle portion extending from the handle portion;

a metering valve carried in the body;

a finger-engageable actuator carried by the body and coupled to the metering valve to move the metering valve;

a nozzle carried by the body nozzle portion;

a discharge mode valve carried by the body nozzle portion; and a thumb-engageable actuator carried by the body nozzle portion and coupled to the discharge mode valve to move the discharge mode valve between different discharge modes of operation.

2. The sprayer of claim 1, wherein the thumb-engageable actuator is slidable in a direction toward and away from an outlet of the body.

3. The sprayer of claim 2, wherein the thumb-engageable actuator is translatable toward an outlet of the sprayer to move the discharge mode valve into a spraying mode, and is translatable away from the outlet to move the discharge mode valve into an aerating mode.

4. The sprayer of claim 1, wherein the handle portion of the body includes a handle axis, and the nozzle portion of the body includes a nozzle axis disposed at a non-zero angle with respect to the handle axis, wherein the thumb-engageable actuator is slidable substantially parallel to a nozzle axis.

5. The sprayer of claim 1, wherein the nozzle portion includes a top, a bottom, and sides between the top and the bottom, wherein the thumb-engageable actuator is carried through at least one of the sides.

6. The sprayer of claim 1, wherein the nozzle portion includes a top, a bottom, and sides between the top and the bottom, wherein the thumb-engageable actuator is carried through at least one of the sides and is located axially forward of the finger-engageable actuator along a nozzle axis.

7. The sprayer of claim 1, wherein the nozzle portion includes a top, a bottom, and sides between the top and the bottom, wherein the thumb-engageable actuator is carried through at least one of the sides and is located axially rearward of the finger-engageable actuator along a nozzle axis.

8. An assembly comprising the sprayer of claim 1 and a hose having a coupling coupled to the body at an inlet of the body.

9. A sink comprising the assembly of claim 8 and a sink mounting flange carrying the sprayer.

10. A handheld sink sprayer with single-handed metering and discharge mode adjustment, and comprising:

a body including an inlet, an outlet, a handle portion having the inlet and a handle axis, and a nozzle portion extending from the handle portion and having the outlet and a nozzle axis disposed at a non-zero angle with respect to the handle axis;

a metering valve carried in the handle portion of the body and normally being in a closed-flow position and being movable to an open-flow position;

a finger-engageable actuator carried by the body and coupled to the metering valve to move the metering valve from the closed-flow position toward the open-flow position;

a nozzle carried by the body nozzle portion;

a discharge mode valve carried by the body nozzle portion and movable between the different discharge modes of operation; and a thumb-engageable actuator carried by the nozzle portion of the body and coupled to the discharge mode valve, wherein the thumb-engageable actuator is movable toward the outlet to move the discharge mode valve into one discharge mode and away from the outlet to move the discharge mode valve into another discharge mode.

11. The sprayer of claim 10, wherein the thumb-engageable actuator is slidable substantially parallel with respect to the nozzle axis.

12. The sprayer of claim 10, wherein the nozzle portion includes a top, a bottom, and sides between the top and the bottom, wherein the thumb-engageable actuator is carried through at least one of the sides.

13. The sprayer of claim 10, wherein the thumb-engageable actuator is located axially forward of the finger-engageable actuator along the nozzle axis.

14. The sprayer of claim 10, wherein the thumb-engageable actuator is located axially rearward of the finger-engageable actuator along the nozzle axis.

15. An assembly including the sprayer of claim 10, and a hose having a coupling coupled to the body at the inlet of the body.

16. A sink including the assembly of claim 15 and a sink mounting flange carrying the sprayer.

17. A handheld, gun-style, flange-mount sink sprayer with single-handed metering and discharge mode adjustment, and comprising:

a body including an inlet to receive fluid into the sprayer, an outlet to discharge fluid out of the sprayer, a handle portion having the inlet and a handle axis, and a nozzle portion extending from the handle portion and having the outlet, a top, a bottom, and sides between the top and the bottom, and a nozzle axis disposed at a non-zero angle with respect to the handle axis;

a metering spool valve carried in the handle portion of the body and normally being in a closed-flow position and being movable to an open-flow position;

a finger-actuated trigger carried by the body and coupled to the metering spool valve to translate the metering spool valve from the closed-flow position toward the open-flow position, in response to application of pressure by a finger of a hand of a user;

a nozzle carried by the body nozzle portion;

a discharge mode poppet valve carried by the body nozzle portion translatable substantially parallel to the nozzle axis between the different discharge modes of operation; and a thumb-actuated slider carried by a side of the nozzle portion of the body and coupled to the discharge mode poppet valve, wherein the slider is translatable toward the outlet to translate the discharge mode valve into the spraying mode and away from the outlet to translate the discharge mode valve into the aerating mode, in response to application of pressure by a thumb of the same hand of the user.

18. The sprayer of claim 17, wherein the slider is slidable substantially parallel to the nozzle axis and is carried through at least one of the sides of the nozzle portion of the body.

19. The sprayer of claim 17, wherein the slider has a centroid that is positioned along the nozzle axis in a location that is forward of a centroid of the trigger.

20. The sprayer of claim 17, wherein the slider has a centroid that is positioned along the nozzle axis in a location that is rearward of a centroid of the trigger.

21. The sprayer of claim 1, adapted to be metered or turned on/off with one or more fingers of one hand, and to be adjusted from one discharge mode to another with a thumb of the same hand.

* * * * *